US011982021B2

(12) United States Patent
Haunschild

(10) Patent No.: US 11,982,021 B2
(45) Date of Patent: May 14, 2024

(54) METHOD AND HANDLING UNIT FOR TRANSFERRING A SLIVER FROM A SLIVER CAN INTO A WORKSTATION

(71) Applicant: Maschinenfabrik Rieter AG, Winterthur (CH)

(72) Inventor: Helmut Haunschild, Dietfurt (DE)

(73) Assignee: MASCHINENFABRIK RIETER AG, Winterthur (CH)

( * ) Notice: Subject to any disclaimer, the term of this patent is extended or adjusted under 35 U.S.C. 154(b) by 0 days.

(21) Appl. No.: 17/960,294

(22) Filed: Oct. 5, 2022

(65) Prior Publication Data

US 2023/0115456 A1 Apr. 13, 2023

(30) Foreign Application Priority Data

Oct. 7, 2021 (DE) ..... 10 2021 125 996.7

(51) Int. Cl.
*D01H 9/18* (2006.01)
*D01H 13/14* (2006.01)

(52) U.S. Cl.
CPC ..... *D01H 9/18* (2013.01); *D01H 13/14* (2013.01)

(58) Field of Classification Search
CPC ..... D01H 5/005; D01H 15/00; D01H 4/48; D01H 4/50; D01H 4/52; D01H 9/00; D01H 9/005; D01H 9/008; D01H 13/14; D01H 13/32; B65H 67/08
See application file for complete search history.

(56) References Cited

U.S. PATENT DOCUMENTS 3,403,866 A * 10/1968 Bell ..... D01H 13/24 242/476.1
4,030,281 A * 6/1977 Schopper ..... D01H 13/14 19/0.25
5,189,872 A * 3/1993 Mima ..... B65H 67/0405 57/58.49
5,517,404 A * 5/1996 Biber ..... D01H 13/32 700/130
5,526,634 A * 6/1996 Mima ..... D01H 15/007 57/279

(Continued)

FOREIGN PATENT DOCUMENTS

DE 38 02 414 A1 8/1989
DE 4134994 A1 * 4/1992 ..... D01H 15/007

(Continued)

OTHER PUBLICATIONS

German Patent Office Search Report, dated May 20, 2022.
EPO Search Report, dated Mar. 23, 2023.

*Primary Examiner* — Patrick J. Lynch
(74) *Attorney, Agent, or Firm* — Dority & Manning, P.A.

(57) ABSTRACT

A method and associated handling unit transfer a sliver from a sliver can into a workstation of a sliver processing textile machine that has a plurality of identical workstations arranged next to one another. The handling unit is stopped at the workstation and the sliver is captured with the handling unit at the sliver can. The captured sliver is transferred to a receiving unit of the workstation and, after the sliver has been transferred, the sliver is released from the handling unit as the handling unit leaves the workstation. After the sliver has been released, a check is performed to determine whether the sliver has been completely removed from the handling unit.

9 Claims, 4 Drawing Sheets

(56) References Cited

U.S. PATENT DOCUMENTS

| | | | | |
|---|---|---|---|---|
| 2020/0080238 | A1* | 3/2020 | Ueding | D01H 15/013 |
| 2021/0087014 | A1* | 3/2021 | Bahlmann | B65H 51/205 |

FOREIGN PATENT DOCUMENTS

| | | | | |
|---|---|---|---|---|
| DE | 4341731 | A1 * | 6/1995 | B65H 73/00 |
| DE | 198 58 986 | A1 | 6/2000 | |
| EP | 0 770 717 | A2 | 5/1997 | |
| EP | 3 620 560 | A1 | 3/2020 | |

* cited by examiner

METHOD AND HANDLING UNIT FOR TRANSFERRING A SLIVER FROM A SLIVER CAN INTO A WORKSTATION

FIELD OF THE INVENTION

The present invention relates to a method for transferring a sliver from a sliver can into a workstation of a sliver-processing textile machine, in particular an open-end spinning machine, wherein a plurality of identical workstations are arranged next to one another and a handling unit is displaceable along the plurality of workstations, wherein, in order to transfer the sliver, the handling unit stops at the workstation, the sliver is captured by the handling unit at the sliver can and transferred to a receiving unit of the workstation, and wherein, after the sliver has been transferred, the handling unit releases the sliver and leaves the workstation.

The invention also relates to a handling unit for transferring a sliver from a sliver can into a workstation of a sliver-processing textile machine, in particular an open-end spinning machine, at which a plurality of identical workstations are arranged next to one another, wherein a drive unit is assigned to the handling unit for displacing along the plurality of workstations, and at least one handling element and a control unit are assigned to the handling unit for transferring the sliver, in order to capture the sliver at the sliver can and transfer the sliver to a receiving unit of the workstation, and wherein, after the sliver has been transferred, the handling elements release the sliver and the handling unit leaves the workstation.

BACKGROUND

EP 0 770 717 A2 describes a method for pneumatically picking up and feeding a sliver—at a sliver end prepositioned for pick-up by a sliver feeder—deposited in a can at an open-end spinning machine, and a device for inserting this sliver end into a clamping area between a delivery roller and a feed trough of a feed device. The sliver end is prepositioned in the center of the can or hanging over the rim of the can and is pneumatically captured by a sliver feeder and transferred to the feed device. The transfer takes place such that the suction air flow is switched into a stream of compressed air and, as a result, the sliver is removed from the sliver feeder and the sliver end is blown into the clamping area of the feed device.

DE 198 58 986 A1 relates to an operating unit for a sliver-processing textile machine, in particular for an open-end spinning machine. The operating unit is mounted on an operating carriage of the open-end spinning machine and includes a slide, which is displaceable orthogonally to the machine longitudinal axis of the textile machine. Arranged on this slide are a sensor unit for detecting the particular sliver can position, a handling element for picking up a leading end of a sliver hanging over the rim of the sliver can, a suction and clamping unit for cutting the sliver to the exact length, and a compressor opener having a pneumatic manipulator for transporting the sliver within the sliver compressor of an open-end spinning device.

The disadvantage of these two embodiments is that there is a risk that the sliver will not be separated from the handling elements after the sliver has been captured and transferred to the spinning device. In this case, when the handling unit leaves the spinning station, a sliver is carried along, as a so-called drag sliver, by the handling unit along the further workstations and can result in considerable disruptions of the spinning operation of multiple spinning stations.

SUMMARY OF THE INVENTION

A problem addressed by the present invention is that of eliminating the disadvantages known from the prior art, in particular, of preventing a drag sliver from being generated. Additional objects and advantages of the invention will be set forth in part in the following description, or may be obvious from the description, or may be learned through practice of the invention.

The problems are solved using a method and a handling unit having the features described and claimed herein.

The invention provides a method for transferring a sliver from a sliver can into a workstation of a sliver-processing textile machine, in particular an open-end spinning machine, wherein a plurality of identical workstations are arranged next to one another and a handling unit is displaceable along the plurality of workstations. In order to transfer the sliver, the handling unit stops at the workstation and the sliver is preferably captured at its end by the handling unit at the sliver can and transferred to a receiving unit of the workstation, for example, a feed device or a holder at the workstation. After the sliver has been transferred, the handling unit releases the sliver and leaves the workstation. According to the invention, after the sliver has been released, a check is carried out to determine whether the sliver has been completely removed from the handling unit. It is therefore ensured that no sliver has remained stuck on the handling unit and is carried along as the handling unit displaces to another workstation. The drag sliver arising as a result would get pulled, starting from the can or the workstation, along the textile machine over possibly multiple workstations. The drag sliver could break slivers at the other workstations or unite with these slivers and, in this way, also result in disruptions. Due to the check, measures can be taken to prevent a drag sliver if it has been determined that the sliver has not been completely removed from the handling unit.

Preferably, the check is carried out after the workstation has been left. If a drag sliver is present, it would stretch between the can, the handling unit, and the workstation. As a result, it is particularly easy to determine whether the sliver has become completely detached from the handling unit. In particular, as a result, it is ensured that an alarm is not triggered even though the sliver has already become detached during a brief movement of the handling unit away from the workstation.

In an advantageous embodiment of the invention, the handling unit is stopped if it is determined that the sliver has not been completely removed. It is therefore ensured that the handling unit does not carry the drag sliver along over a great distance. Due to the stoppage of the handling unit, a sufficient amount of time is made available to detach the sliver from the handling unit.

If, preferably, the sliver is removed from the handling unit, in particular is cut and/or suctioned and/or blown off, if it is determined that the sliver has not been completely removed, the handling unit is subsequently ready for use once again. The cutting and/or sucking-off and/or blowing-off of the sliver can be carried out by the handling unit itself or manually by an operator.

It is also advantageous when a signal to an operator of the machine is generated if it is determined that the sliver has not been completely removed. The operator can then detach the sliver from the handling unit and restart the sliver supply at the workstation at which the drag sliver was generated.

A handling unit according to the invention is utilized for transferring a sliver from a sliver can into a workstation of a sliver-processing textile machine, in particular an open-end spinning machine. A plurality of identical workstations are arranged next to one another at the textile machine. A drive unit is assigned to the handling unit, with which the handling unit can be displaced along the plurality of workstations. At least one handling element is assigned to the handling unit for transferring the sliver from the sliver can to the workstation. In addition, a control unit is provided in order to capture the sliver with the handling elements at the sliver can and transfer the sliver to a receiving unit of the workstation. The receiving unit of the workstation can be an intake unit with which the sliver is drawn into a feed device and an opening roller. Alternatively, the receiving unit can also be a holder into which the sliver is placed by the handling element and from which the sliver is subsequently removed by an operator or by a gripper arranged at the workstation and is subsequently transferred to the intake unit.

The handling unit can be arranged, for example, on a maintenance unit, such as a robot, which patrols along the textile machine and carries out maintenance tasks. The handling unit can also be arranged, however, on a can changer, which is responsible for exchanging empty cans for full cans and can move to various textile machines.

After the sliver has been transferred to the workstation, the handling elements release the sliver and the handling unit leaves the workstation. According to the invention, a sensor is assigned to the handling unit, with which, after the sliver has been released, a check is carried out and it is determined whether the sliver has been completely removed from the handling unit. Therefore, a check is carried out to determine whether the sliver has actually been released from the handling unit or whether the sliver is still located on the handling unit, as, for example, it is clamped at a point of the handling unit. Due to this check, it can be ensured that the sliver is not located on the handling unit despite having been released and would be carried along the textile machine as the handling unit displaces to another workstation. This so-called drag sliver would cause a disruption not only at the workstation at which the fault has occurred, but also at further workstations that are passed by the handling unit.

It is advantageous when the sensor is connected to the control unit of the handling unit. The sensor can output a signal or, alternatively, dispense with an appropriate signal if a drag sliver has been detected. The sensor can therefore influence the control of the drive unit of the handling unit and, thus, cause the handling unit to be stopped or allow the handling unit to continue. It is also possible that a display unit is actuated after an expected signal of the sensor has been checked, for example, in order to alert an operator to the presence of the drag sliver.

Preferably, the handling unit includes handling elements for at least one of the following actions: picking up the sliver out of the sliver can, cutting the sliver to a desired length, giving the sliver a point, inserting the sliver into an intake unit of the workstation. The sliver to be transferred can therefore be picked up from the sliver can, prepared, and transferred to the workstation.

In an advantageous embodiment of the invention, a cutting unit and/or a suction unit and/or a blower unit are/is assigned to the handling unit. Therefore, the sliver can be released from the handling unit and the faulty workstation can be started up again. The handling unit can also carry out other tasks. The cutting unit cuts the sliver clinging to the handling unit and, thus, frees the sliver from the handling unit. A remainder of the sliver can be subsequently suctioned by the suction unit and/or blown off by the blower unit and removed from the handling unit or at least from the handling elements.

The invention is designed according to the preceding description, wherein the aforementioned features can be present individually or in any combination.

BRIEF DESCRIPTION OF THE DRAWINGS

Further advantages of the invention are described in the following exemplary embodiments, wherein.

DETAILED DESCRIPTION

In the following description of the alternative exemplary embodiments represented in the figures, the same reference signs are utilized for features that are identical or at least comparable in terms of their configuration and/or mode of operation. Provided the features are not described in detail again, their design and/or mode of operation correspond/corresponds to the design and mode of operation of the above-described features. For the sake of greater clarity, reference signs for previously described components have not been individually included in the figures.

Figure 1:
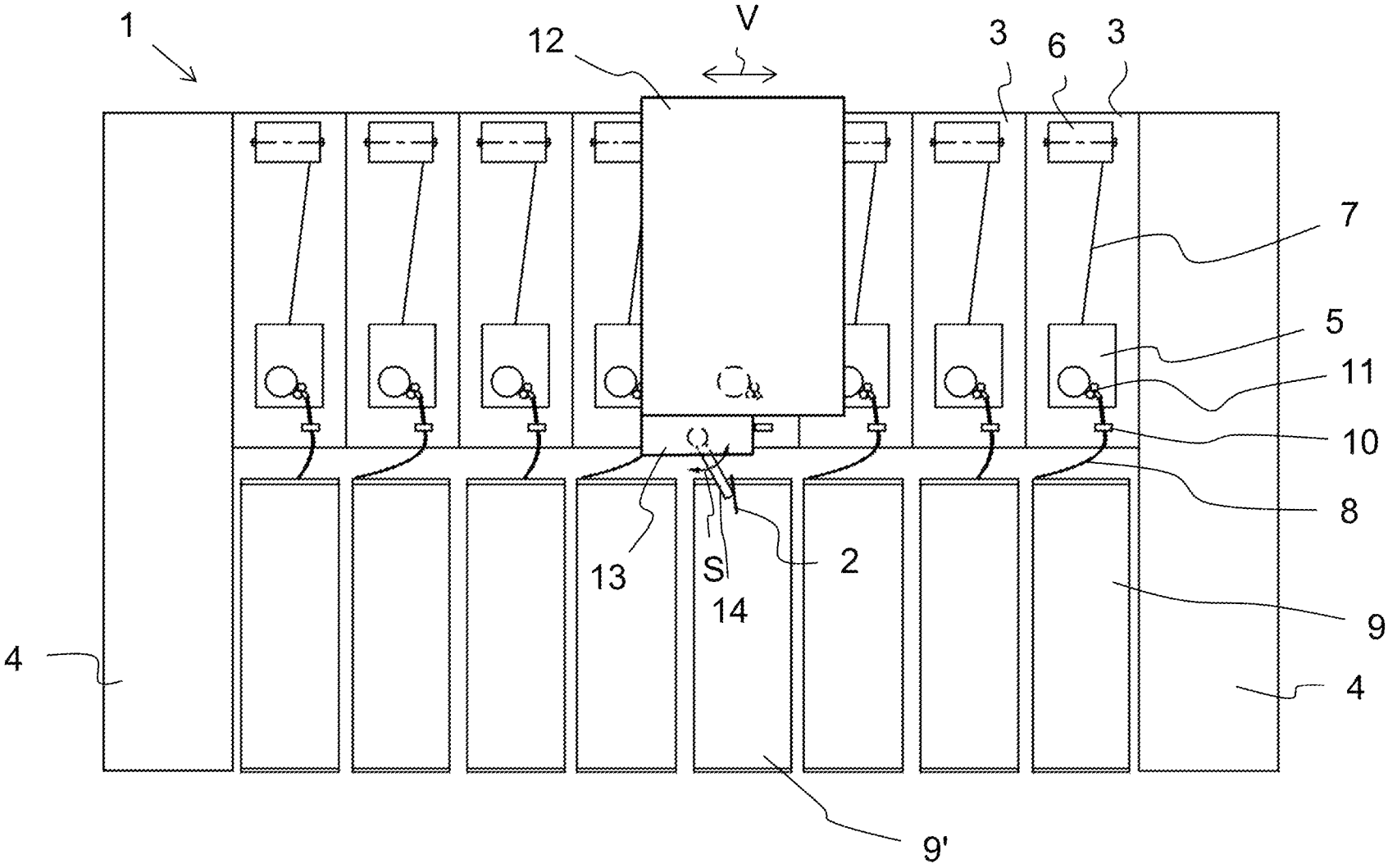
FIG. 1 shows a front view of a spinning machine with a handling unit before a sliver end has been grasped.

FIG. 1 shows a front view of a textile machine, specifically an open end spinning machine 1 in this case, before a sliver end 2 has been grasped. The spinning machine 1 has a plurality of workstations 3, specifically spinning stations in this case, which are arranged next to one another. A machine frame 4 is located at each of the two ends of the spinning machine 1. Each workstation 3 includes a spin box 5 as well as a bobbin 6, onto which a yarn 7 is wound. The yarn 7 is spun in the spin box 5 from a sliver 8, which is fed to the spin box 5 from a can 9. The sliver 8 is actively fed to the spin box 5 with the aid of a feed drive 11, which consists of at least one driven roller. On the path between the can 9 and the spin box 5, the sliver 8 is guided through a loop catcher 10, which is intended to prevent the formation of loops—which could result in a sliver break—in the sliver 8 during the withdrawal of the sliver 8 from the can 9. The cans 9 are represented here as so-called elongate cans, which have a width that approximately corresponds to the width of one workstation 3. The cans 9 extend, with their longitudinal side, deep underneath the workstation 3, and so the cans 9 can accommodate as much sliver 8 as round cans, which generally have an approximate diameter that approximately corresponds to the width of two workstations 3. The exchange of elongate cans is easier to automate than is the case for round cans, because there are no rear cans that must be switched with the front can during an exchange.

When the sliver 8 contained in the can 9 has been used up, the can 9 is exchanged for a full can 9. The sliver end 2 of the sliver 8 contained therein hangs, for example, over the upper rim of the can 9', as represented by the can 9'. The sliver 8 is missing at the workstation 3 to be supplied and at which the sliver 8 is to be re-pieced and inserted into the feed drive 11, which is represented here by a dashed line, in order to be able to continue the spinning operation. The adjacent workstations 3 continue to receive their sliver 8 from the cans 9 assigned thereto.

When a workstation 3 reports to a control unit that there is a need for maintenance, for example, a sliver 8 is missing at a certain workstation 3, a robot 12 is stopped at this workstation 3 and begins its maintenance work. The robot 12 is designed such that it can displace back and forth along the spinning machine 1 according to the double arrow V.

A handling unit 13 on which a sliver gripper 14, as a handling element, is located, is arranged on the robot 12. The handling unit 13 is displaceable together with the robot 12 along the spinning machine 1. In the exemplary embodiment represented here, the sliver gripper 14 is a suction tube, which is capable of sucking in the sliver end 2. The sliver gripper 14 can be swiveled according to the double arrow S, so that it can move the sucked-in sliver end 2 in the direction of the feed drive 11 in order to feed the sliver end 2 to the workstation 3. The sliver gripper 14 can also be designed in a way other than a pneumatically operated suction tube, of course. For example, a mechanical gripper is also possible, which grasps the sliver end 2 at the can 9'.

Figure 2:
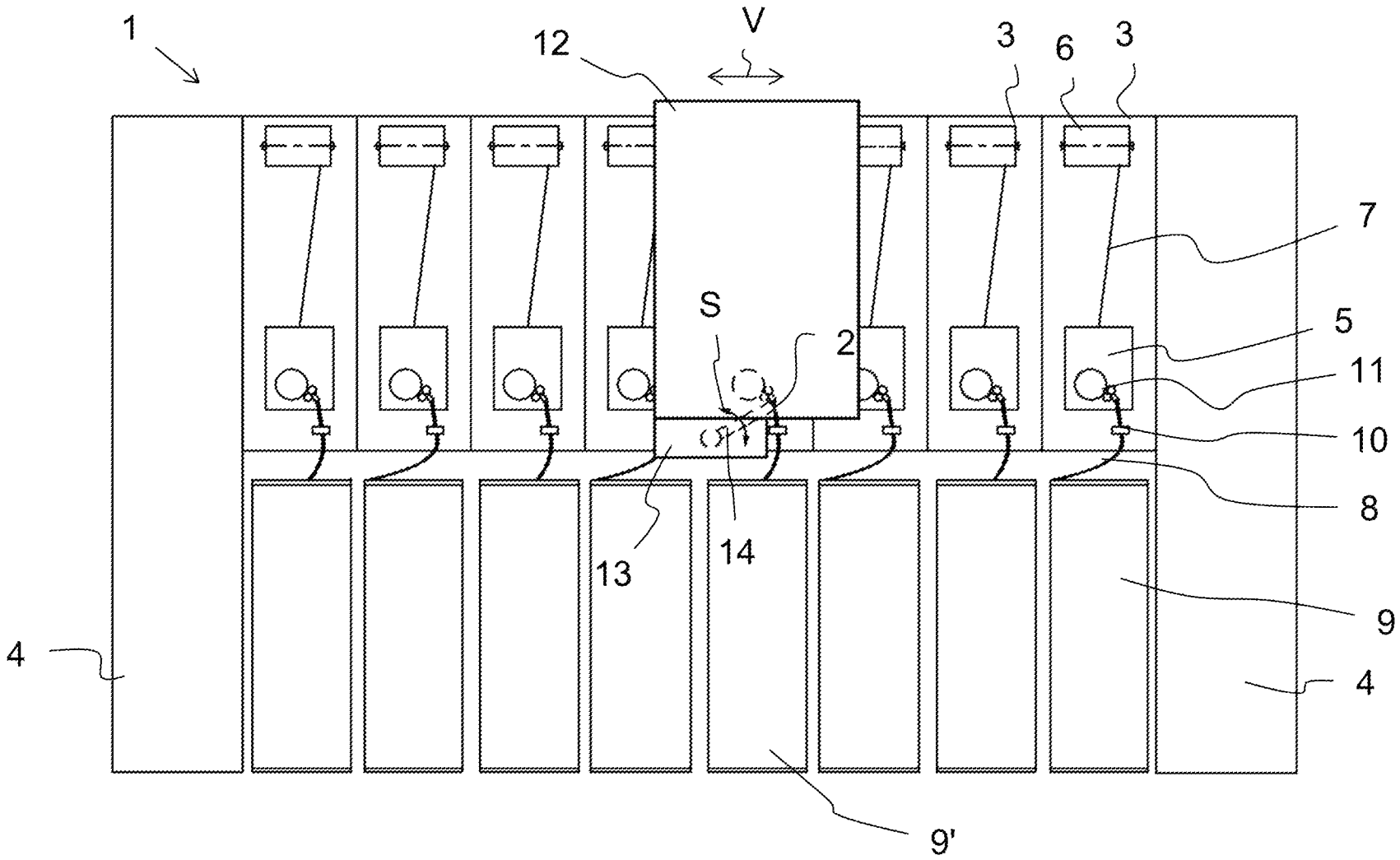
FIG. 2 shows the spinning machine from FIG. 1 with a handling unit during the feeding of a sliver end at a workstation.

FIG. 2 shows the spinning machine from FIG. 1 during the feeding of the sliver end 2 at the workstation 3. The robot 2 is moved according to the arrow V in the direction of the workstation 3 to be supplied, and is positioned there. In this representation, the sliver gripper 14 has grasped the sliver end 2 and guides this to the workstation 3. By way of a swivel movement S of the sliver gripper 14 in the direction of the feed drive 11 of the workstation 3, the sliver 8 or the sliver end 2 is moved toward the feed drive 11 of the workstation 3 and, there, can be inserted into the feed drive 11, for example, with the aid of a pressure pulse from the sliver gripper 14. For the purpose of inserting the sliver 8 into the loop catcher 10, either the sliver gripper 14 can have units that thread the sliver 8 through the loop catcher 10, or the loop catcher 10 is designed such that this can perform its function, for example, by the sliver 8 being inserted laterally into the loop catcher 10.

When the sliver end 2 has been inserted into the feed drive 11 and the spinning process is ready for spinning yarn 7 once more or is underway again, the robot 12 leaves the workstation 3 to be supplied and carries out further maintenance work at other workstations 3.

Figure 3:
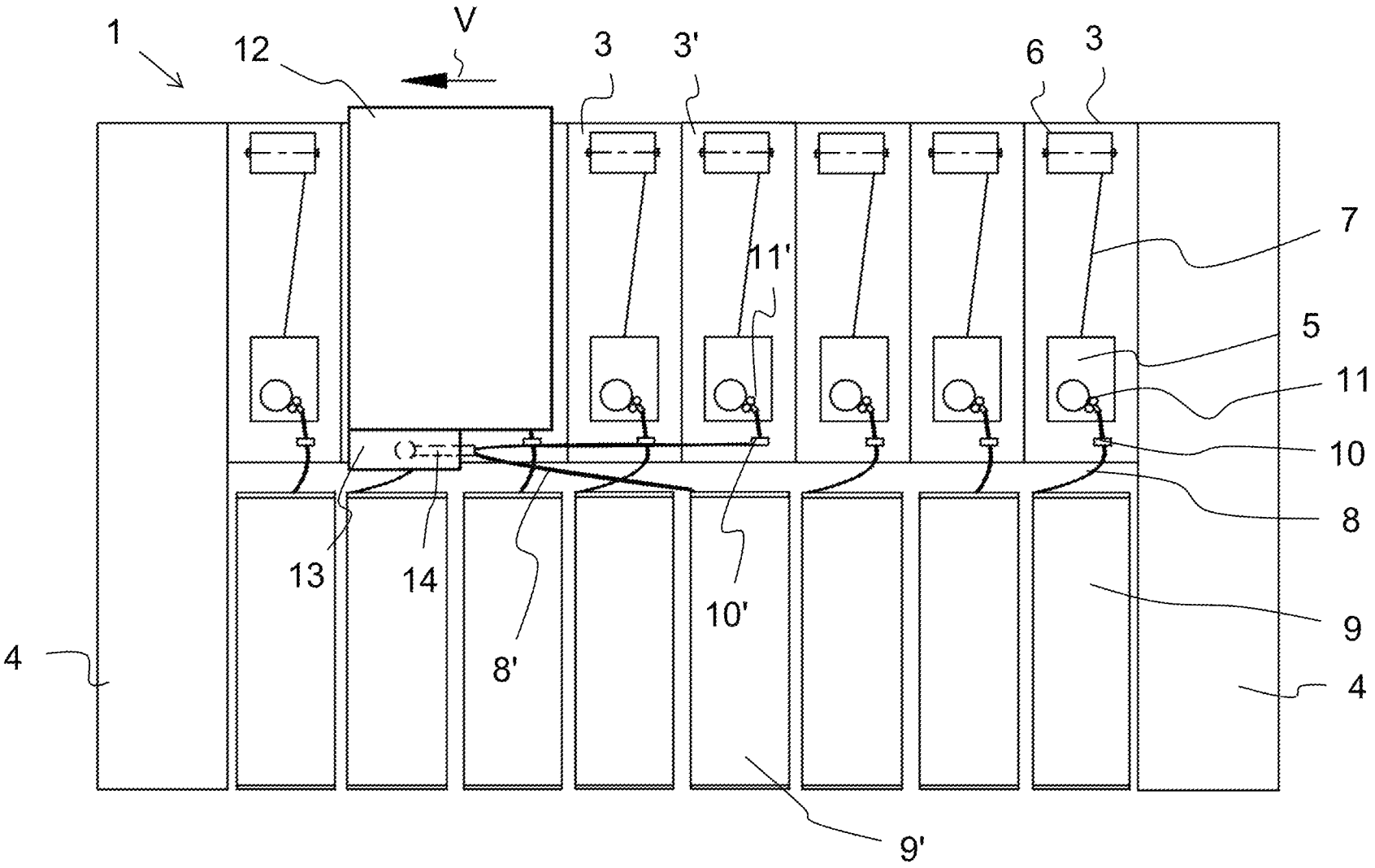
FIG. 3 shows the spinning machine from FIG. 1 with a handling unit, in the case of which a drag sliver is generated.

FIG. 3 shows the spinning machine 1 from FIG. 1 with the handling unit 13, in the case of which the sliver 8' forms a drag sliver. The drag sliver arises due to the fact that, at the workstation 3', the sliver 8' is withdrawn from the sliver can 9' and, in fact, continues to be drawn into the loop catcher 10' and the feed drive 11', but is still held in the sliver gripper 14 of the handling unit 13. As a result, the sliver 8' is pulled along the workstations 3 that are adjacent to the workstation 3' when the robot 12, with the handling unit 13, leaves the workstation 3' in the arrow direction V. In most cases, the sliver 8' will break between the sliver gripper 14 and the loop catcher 10'. However, the sliver 8' is nevertheless pulled along the workstations 3 out of the sliver can 9' due to the traveling motion of the robot 12 and of the fixation in the sliver gripper 14. There is a risk that the spinning operation of the adjacent workstations 3 will be disrupted, for example, by one of the slivers 8 drawn in there being broken or the sliver 8' becoming entangled with one of these slivers 8 and also being drawn into the workstation 3. The present invention is intended to prevent such a drag sliver 8'.

Figure 4:
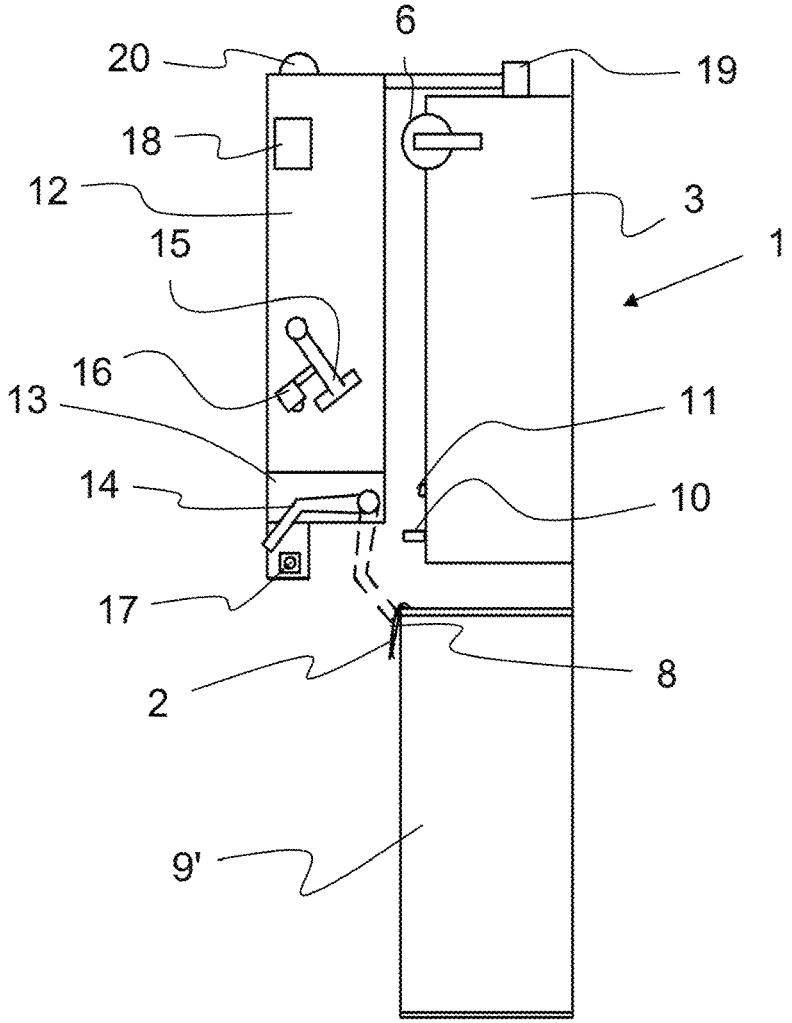
FIG. 4 shows a side view of a spinning machine with various handling elements of the handling unit.

FIG. 4 shows a side view of a spinning machine 1 having various handling elements of the handling unit 13. The sliver can 9', out of which a sliver end 2 hangs, is arranged at the workstation 3. The robot 12, to which the handling unit 13 is assigned, is arranged in front of the workstation 3. It is possible for the handling unit 13 to grasp the sliver end 2 at the sliver can 9'. Next, the sliver end 2 is prepared in order to be able to be inserted into the loop catcher 10 and the feed drive 11. The sliver gripper 14, which is provided as the first handling element, is swiveled in the direction of the sliver end 2 (represented by dashed lines) and, there, grasps the sliver end 2. This grasping can be carried out pneumatically, with a suction applied in the sliver gripper 14, or also with a mechanical gripper, for example, a nipper.

The sliver end 2 is then fed to a further handling element of the handling unit 13. This further handling element is a sliver preparing mechanism 15, into which the sliver end 2 is inserted and, for example, given a point with the aid of an air flow located therein. Due to this pointed end of the sliver 8, the subsequent insertion of the sliver end 2 into the loop catcher 10 and the feed drive 11 is facilitated. The handling unit 13 can include further handling elements (which are not represented here for the sake of greater clarity), for example, in order to cut the sliver 8 to the proper length or transfer the sliver 8 from one handling element to the next handling element.

In order to prevent the sliver 8 from remaining stuck in one of the handling elements, specifically the sliver gripper 14 or the sliver preparing mechanism 15 in this case, and to prevent the robot 12 from carrying the sliver 8 along upon leaving the workstation 3, sensors 16 and 17 are assigned to the handling elements, specifically the sliver gripper 14 and the sliver preparing mechanism 15 in this case. Before the robot 12 leaves the workstation 3, although at the latest shortly after having moved away from the workstation 3, the sensors 16 and 17 determine whether the sliver 8 has been completely removed from the handling unit 13 and the handling elements. If it is determined in this check that the sliver 8 is still located in the handling unit 13, a drive unit 19 of the robot 12 is stopped, by means of a control command sent to a control unit 18 of the robot 12, from moving the robot 12 away or continuing to move the robot 12 away. As a result, in the event of a malfunction of the handling unit, in which the sliver 8 has not been completely detached from the handling unit or the handling elements, such as, for example, the sliver gripper 14 or the sliver preparing mechanism 15, it is reliably ensured that the sliver 8 is not pulled along the adjacent workstations 3 and, due to this arising drag sliver, the operation of adjacent workstations 3 is not disrupted.

If it is detected by at least one of the sensors 16 or 17 that a sliver 8 is still located in the area of the handling unit 13, a signal to an operator of the spinning machine 1 is preferably generated. This can be carried out, for example, with a display unit 20 on the robot 12 or directly with a notification to the operator. The display unit 20 is actuated if it is determined that the sliver 8 has not been completely removed and the expected signal of the sensor 16 or 17 is not present.

It can also be provided that a cutting unit and/or a suction unit and/or a blower unit are/is present for detaching the sliver 8 from the handling unit 13 or at least from the handling elements. This can be a separate unit, or existing handling elements are utilized in order to detach the sliver 8 from the handling unit 13, for example, by reactivating the handling elements.

Figure 5A:
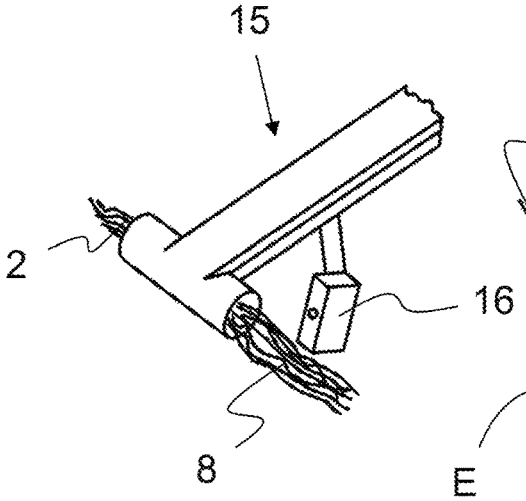
FIGS. 5*a*, 5*b* show a perspective view of a handling element of the handling unit.

In FIG. 5*a*, a perspective view of a handling element in the handling unit 13 is represented. This is the sliver preparing mechanism 15 according to FIG. 4. It is apparent here that the sliver 8, with its sliver point 2, has been inserted into the sliver preparing mechanism 15. A blowing nozzle, with which the sliver end 2 is given a point, is arranged in the sliver preparing mechanism 15. As a result, the sliver end 2 is very highly suited to be placed and fed into the loop catcher 11 and the feed drive 11.

Figure 5B:
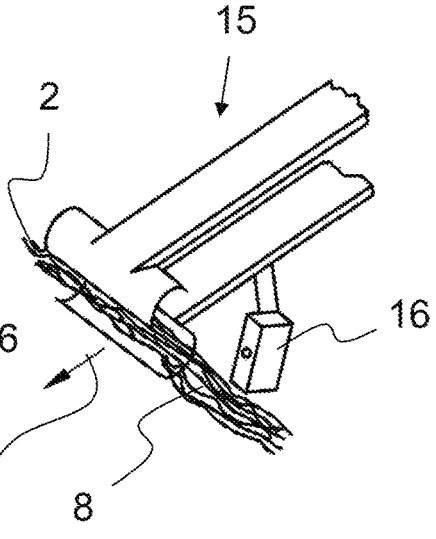

In a particularly advantageous embodiment, as represented in FIG. 5*b*, the sliver preparing mechanism 15 can be opened in its longitudinal direction such that the sliver 8, after having been prepared, can be laterally removed according to the arrow E. This is necessary, for example, for the case in which the sliver end 2 has been inserted, from the sliver preparing mechanism 15, into the feed drive 11 and the sliver preparing mechanism 15 must subsequently detach from the sliver 8. The sliver 8 remains in the feed drive 11 and the sliver preparing mechanism 15 can be moved back into its initial position. During this detachment of the sliver 8 from the sliver preparing mechanism 15, there is a risk that the sliver 8 will remain stuck in the sliver preparing mechanism 15 and, thus, be withdrawn from the sliver can 9' as the robot 12 continues displacing and form a drag sliver. In order to prevent this, the sensor 16 is arranged close to the sliver preparing mechanism 15. By means of the sensor 16, it is determined whether the sliver 8 has been removed from the sliver preparing mechanism 15 before the robot 12 continues displacing. If this is the case, the travel of the robot 12 is continued. Otherwise, the travel of the robot 12 is interrupted. The sensor 17 from FIG. 4 operates in the same way. With respect to this sensor 17 as well, a check is carried out before the robot 12 continues displacing or, at the latest, shortly after the robot 12 continues displacing, to determine whether the sensor 17 detects a sliver 8. If this is the case, the continued travel or the initial travel of the robot 12 is interrupted here as well.

The present invention is not limited to the represented and described exemplary embodiments. Modifications within the scope of the claims are also possible, as is any combination of the features, even if they are represented and described in different exemplary embodiments.

LIST OF REFERENCE SKINS

1 spinning machine
2 sliver end
3 spinning station
4 machine frame
5 spin box
6 bobbin
7 yarn
8 sliver
9 can
10 loop catcher
11 feed drive
12 robot
13 handling unit
14 sliver gripper
15 sliver preparing mechanism
16 sensor
17 sensor
18 control unit
19 drive unit
20 display unit
S swivel movement
V displacement movement
E removal direction

The invention claimed is:

1. A method for transferring a sliver from a sliver can into a workstation of a sliver processing textile machine that has a plurality of identical workstations arranged next to one another and a handling unit that is displaceable along the plurality of workstations, the method comprising:

stopping the handling unit at the workstation and capturing the sliver with the handling unit at the sliver can;

transferring the captured sliver to a receiving unit of the workstation;

after the sliver has been transferred, releasing the sliver from the handling unit as the handling unit leaves the workstation;

after the sliver has been released and after at least an initial movement of the handling unit away from the workstation, performing a check to determine whether the sliver has been completely removed from the handling unit.

2. The method according to claim 1, wherein the check is carried out after the handling unit has left the workstation.

3. The method according to claim 1, further comprising stopping displacement of the handling unit when the check determines that the sliver has not been completely removed from the handling unit.

4. The method according to claim 1, further comprising removing the sliver from the handling unit when it is determined by the check that the sliver has not been completely removed from the handling unit.

5. The method according to claim 1, further comprising generating a signal to an operator of the textile machine when the check determines that the sliver has not been completely removed from the handling unit.

6. A handling unit that transfers a sliver from a sliver can into a workstation of a sliver processing textile machine that includes a plurality of the workstations arranged next to one another, comprising:

a drive unit configured with the handling unit to displace the handling unit along the plurality of workstations;

handling elements and an associated control unit configured to capture the sliver at the sliver can and transfer the sliver to a receiving unit of the workstation, the handling elements configured to release the sliver after the sliver has been transferred;

the handling unit controlled by the control unit to leave the workstation after the sliver has been transferred;

a sensor configured with the handling unit, the sensor configured to perform a check after the sliver has been released and after an initial movement of the handling unit away from the workstation to determine whether the sliver has been completely removed from the handling unit.

7. The handling unit according to claim 6, wherein the sensor is connected to the control unit in order to control the drive unit or to actuate a display unit depending on a result of the check performed by the sensor.

8. The handling unit according to claim 6, wherein the handling elements are configured to perform one or more of: picking up the sliver out of the sliver can; cutting the sliver to a desired length; giving the sliver a point; or inserting the sliver into an intake unit of the workstation.

9. The handling unit according to claim 6, further comprising one or more of: a cutting unit; a suction unit; or a blower unit to detach the sliver from the handling unit.

* * * * *